United States Patent [19]

Jones et al.

[11] 4,201,898

[45] May 6, 1980

[54] INERTIA SWITCHES

[75] Inventors: Harry Jones, Ashton-under-Lyne; David L. Slater, Oldham, both of England

[73] Assignee: Ferranti Limited, Hollinwood, England

[21] Appl. No.: 911,945

[22] Filed: Jun. 2, 1978

[30] Foreign Application Priority Data

Jun. 4, 1977 [GB] United Kingdom ..... 23840/77

[51] Int. Cl.[2] ..... H01H 35/14

[52] U.S. Cl. ..... 200/61.45 R; 200/61.48; 200/61.51

[58] Field of Search ..... 200/61.45 R, 61.45 M, 200/61.48, 61.49, 61.5, 61.51, 61.52, 276; 102/262; 340/669, 670

[56] References Cited

U.S. PATENT DOCUMENTS

| | | | |
|---|---|---|---|
| 2,983,800 | 5/1961 | Rabinow | 200/61.51 X |
| 3,163,856 | 12/1964 | Kirby | 200/61.45 R X |
| 3,359,550 | 12/1967 | Christensen | 200/61.51 X |

*Primary Examiner*—James R. Scott

*Attorney, Agent, or Firm*—Kerkam, Stowell, Kondracki & Clarke

[57] ABSTRACT

An inertia switch comprises a spiral spring-like member supported by a post in a housing, the spring comprising one contact of the switch and the housing the other. The post is insulated from the housing and provides a terminal for the switch. Acceleration or shock applied to the switch causes the spring-like member to move relative to the housing and when it contacts the housing or approaches a detector located inside and supported by the housing, switching is effected.

9 Claims, 2 Drawing Figures

INERTIA SWITCHES

BACKGROUND OF THE INVENTION

This invention relates to inertia switches.

Inertia switches fall into two main categories. A first type employs a spherical mass held in a stable position by gravity in a groove or between a pair of raised contacts which it bridges, an acceleration force of suitable magnitude applied to the switch causes the body to roll from its stable position thereby opening the circuit between the contacts or operating a switch by its subsequent movement. Examples of this type are shown in British Patent Nos. 1,440,771 and 1,440,772. A second type employs an inertial mass supported as a pendulum either suspended under gravity by a non-resilient cord or supported on a cantilever leaf spring. Examples of this second type are shown in British Patent Nos. 1,391,901 and 849,962.

Inertia switches of the first type require careful handling and setting up to ensure that the freely moving sphere is located correctly, and, as the range of operation is related to the mass of the sphere, the individual dimensions and overall size of the switch are limited by factors outside the control of the designer.

Similarly with switches of the second type even though the moving parts are restrained in their movement, the length of the pendulum or cantilever spring means that in general the dimensions of such switches are not under the control of the designer who may have only a limited volume, in other equipment, in which to place an inertia switch.

SUMMARY OF THE INVENTION

It is an object of the present invention to provide an inertia switch of simple construction which mitigates some or all of the disadvantages of known types of inertia switches.

According to the present invention an inertia switch comprises a first part in the form of a resilient element attached at one end thereof to a support member and coiled about said one end substantially in the form of a spiral, the other end being free to so move, and a second part arranged to cooperate with the first part that movement of said free end through a predetermined distance in response to an acceleration force effects switching of an electric circuit.

BRIEF DESCRIPTION OF THE DRAWINGS

Embodiments of the invention will now be described by way of example with reference to the accompanying drawings, in which.

DESCRIPTION OF THE PREFERRED EMBODIMENTS

Figure 1:
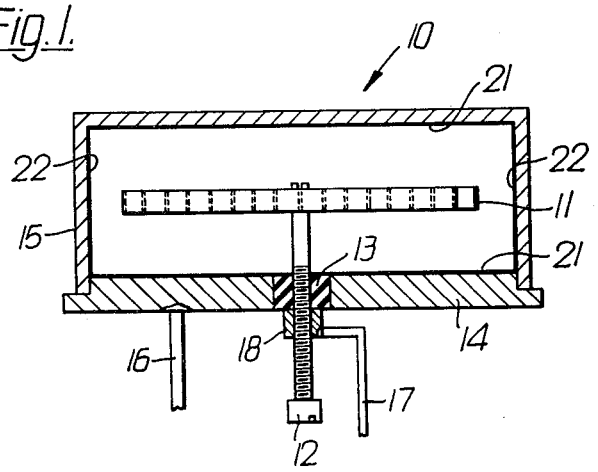
FIG. 1 shows a sectional elevation through a first form of inertia switch according to the present invention.

Referring to FIG. 1, in an inertia switch 10 a first part in the form of a resilient element 11 comprises a coil of spring steel strip attached at one of its ends to a support post 12 and coiled spirally around the post with the other end of the coil free to move. The support post 12 is electrically conductive and is carried in an electrically insulating bush 13 in a casing comprising a circular metal base, or header, 14 of a semiconductor-type package and a metal container 15 enclosing the element 11 and sealed to the header 14 to make electrical contact therewith. The casing comprises a second part of the switch.

A first contact lead 16 is connected to the header 16 and a second contact lead 17 is connected to a bush 18 making electrical connection with the support post 12.

Operation will be considered with the switch mounted with the header 14 in the horizontal plane. In operation, if an acceleration force acts on the switch along the longitudinal axis of the support post 12, that is, in the vertical plane, the inertia of the spring is such that the free end moves relative to the attached end in the opposite direction to the acceleration force. The relative displacement of the ends of the spring depends on the magnitude of the acceleration force. The distance between the rest position of the spring and the top wall 21 of the container, or the header 14, as appropriate, is chosen in accordance with movement representing a predetermined acceleration force such that when such a force exists the free end of the spring makes contact either with the top of the container or with the header and completes an electrical circuit between contacts 16 and 17.

If an acceleration force acts transversely to the longitudinal axis of the support member 12, that is, in the horizontal plane, whether a translational force or a rotational force, the free end of the spring is displaced radially against the resilience maintaining it in its rest position. Under a predetermined value of acceleration force the free end, or any part of the outer turn of the spiral, contacts the peripheral wall of the container and completes an electrical circuit between contacts 16 and 17.

It will be appreciated that the relative sensitivity of the switch in the two planes may be varied by choice of the cross-sectional configuration of the strip and by the overall dimensions of the element.

Furthermore, if it is desirable for the switch to detect acceleration forces in one only of the two orthogonal planes, then detection in the other plane may be inhibited by providing an electrically insulating coating on the appropriate inner surface of the container. For instance, if it is desired to inhibit operation in the vertical plane then the surfaces of the container top 21 and of the header 14 are provided with insulating coatings 21, whereas if it is desired to inhibit operation in the horizontal plane an insulating coating 22 is provided around the inner circumferential wall of the container 15. Alternatively, the insulation may be achieved by replacing part of the casing wall with a "window" of insulating material. It may be desired not to inhibit operation in every direction of the horizontal plane in which case the insulating coating 21 may be omitted at points located relative to the support post 12 in directions for which operation is required. If the switch is to be used where the inner surface of the header is not required to make switching contact with spring 11, the bush 18 may be contained within the housing, the lead 17 being connected thereto by way of an insulating bush in the header.

Figure 2:
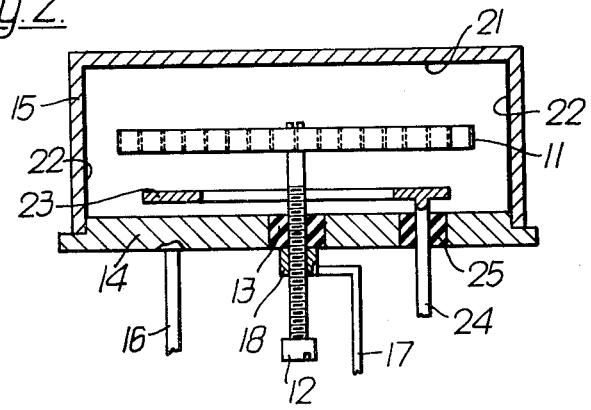
FIG. 2 shows a sectional elevation through an alternative form of inertia switch.

In order to vary the sensitivity of the switch after it has been constructed with components of selected dimensions, the support post 12 may be made movable relative to the bushes 13 and 18 to alter the spacings between the rest position of the spring and the container walls. Sensitivity to acceleration forces in a vertical plane may be varied by moving the support post 12 through the header to alter the distance between the rest position of the spring and the top of the container. FIG. 2 shows an embodiment in which control of sensitivity in the opposite vertical direction is possible. In conjunction with movement of support member 12, a contact member is provided in the form of a ring 23 carried by a support conductor 24 extending through the header, either in contact therewith or insulated from it by a bushing 25. The conductor 24 is slidable through the header to vary the separation between the rest position of the spring and the ring 23. The contact member 23 may be located adjacent the other face of the spiral and the support conductor 24 carried by the wall of container 15 opposite to the header 14. For a substantially circular spring in a circular container the support post 12 and bush 13 may be screw threaded to provide precise axial adjustment. Alternatively, the post may just be slidable through the bushing.

If operation is required in any selected direction in the horizontal plane, sensitivity in that direction may be made variable by using a non-circular, for example, elliptical, coiled spring whereby the separation between the free end, or outer turn, of the spring and the container wall is adjustable by rotation of the support post 12.

In the above described embodiments switching is achieved by mechanical contact between the resilient element 11 and the container 15 or ring 23. It will be appreciated that switching could be effected by sensing the proximity of the element to the container or by causing the spring, or a 'paddle' carried by the free end of the spring, to interrupt or otherwise disturb the passage of a light beam to a photocell, or to unbalance an inductive or capacitive a.c. bridge. In such embodiments the spring could be of a non-conductive material.

Furthermore, it will be appreciated that the orientation in which the switch is operated is not confined to that with which the above embodiments have for convenience, been described; that is, the terms 'vertical' plane and 'horizontal' plane are to be construed as relative to each other rather than absolute.

The inertia switch described with the variations possible may have small dimensions and may conveniently be contained in a container having the same dimensions as those used in semiconductor packages, such as for transistors. The switch may be conveniently carried by a printed circuit board containing components of the circuit for which the switching action is required, resulting in considerable saving in space and packaging costs over known inertia switches.

What we claim is:

1. An inertia switch comprising a first part in the form of a resilient element attached at one end thereof to a support member and coiled about said one end substantially in the form of a spiral, the other end being free to move, a casing enclosing said resilient element, one wall of which casing carries the support member, said support being a post extending through said wall and movable along its length by adjustment means to alter the stable position of the resilient element inside the casing, the resilient element and the walls of said casing being electrically conductive so that movement of said free end through a predetermined distance in response to an acceleration force effects switching of an electric circuit by contact between the resilient element and the walls of the casing, the support post being electrically conductive, connecting the resilient element to one terminal of the switch and being electrically insulated from the casing wall, a suitable part of the casing wall being electrically insulated to prevent switching due to acceleration forces acting to displace the resilient element in a specified direction.

2. An inertia switch as claimed in claim 1 in which said suitable part of the casing wall is coated with an electrically insulating material.

3. An inertia switch as claimed in claim 1 or claim 2 including a contact member disposed in said casing extending in a plane substantially parallel to that of the spiral resilient element and supported by a support conductor extending parallel to the support post and carried by a wall of the casing.

4. An inertia switch as claimed in claim 3 in which the support conductor is slidable along its length by second adjustment means such that the distance between the spiral resilient element and the contact member may be varied.

5. An inertia switch as claimed in claim 3 in which the support conductor is electrically insulated from the wall of the casing and forms a further terminal of the switch.

6. An inertia switch as claimed in claim 3 in which the support conductor is carried by the same wall that carries the support post.

7. An inertia switch as claimed in claim 1 or claim 2 in which the spiral resilient element is spring steel.

8. An inertia switch as claimed in claim 1 or 2 arranged to have different sensitivities in different directions by so coiling the spiral resilient element that the separation of the element and the casing wall is different in different directions of movement of the free end of the spiral resilient element.

9. An inertia switch as claimed in claim 1 or claim 2 in which the cross-section of the resilient element is so chosen as to be deformable in substantially one only of the planes along and orthogonal to the axis of generation of the spiral resilient element.

* * * * *